US005964008A

United States Patent [19]

Lim

[11] Patent Number: 5,964,008

[45] Date of Patent: Oct. 12, 1999

[54] UPRIGHT VACUUM CLEANER

[75] Inventor: Gwi-Tae Lim, Kwangju, Rep. of Korea

[73] Assignee: Samsung Kwang-Ju Electronics Co., Ltd., Kwangju, Rep. of Korea

[21] Appl. No.: 08/987,171

[22] Filed: Dec. 9, 1997

[30] Foreign Application Priority Data

Jul. 22, 1997 [KR] Rep. of Korea ..... 97-19365

[51] Int. Cl.[6] ..... A47L 9/00

[52] U.S. Cl. ..... 15/339; 15/327.1; 15/351; 301/111

[58] Field of Search ..... 15/327.1, 339, 15/351, 340.2, 340.3, 412; 301/111, 112

[56] References Cited

U.S. PATENT DOCUMENTS

| | | | |
|---|---|---|---|
| 2,581,962 | 1/1952 | Langille et al. | 15/412 |
| 2,940,781 | 6/1960 | Erikson | 301/111 |
| 4,530,543 | 7/1985 | Keane | 15/339 |
| 5,222,786 | 6/1993 | Sovis et al. | 301/111 |
| 5,704,091 | 1/1998 | Kilstrom | 15/339 |

FOREIGN PATENT DOCUMENTS

| | | | |
|---|---|---|---|
| 2607754 | 6/1988 | France | 301/112 |

*Primary Examiner*—Terrence R. Till

*Attorney, Agent, or Firm*—Majestic, Parsons, Siebert & Hsue P.C.

[57] ABSTRACT

An upright vacuum cleaner having a suction inlet body for cleaning a floor with rotation of the agitator including the brush assembled by the rubber belt at a motor shaft, a main body rotatively installed with a filter for collecting dust and the like sucked through the suction inlet body by the suction force of the driving means, a handle member disposed at an upper portion of the main body for pushing and dragging around, and a suction hose installed at the main body for sucking dust with suction force of the driving means to be utilized by being inserted into the suction inlet body and to be stored by placing on the handle member, wherein the mobile means comprises: a rotating shaft supported at an inner hole of a body composing of the main body being assembled in mobility and being protruded out of the outer hole with serration formed at both ends thereof; and a pair of rear wheels in a predetermined shape inserted along with the serration of the rotating shaft and inserted though the outer hole of the body being movable with limitation toward the rotating shaft, thereby reducing the number of parts in assembling rear wheels of the mobile means and improving the assembly thereof.

1 Claim, 2 Drawing Sheets

UPRIGHT VACUUM CLEANER

BACKGROUND OF THE INVENTION

1. Field of the Invention

The present invention relates to an upright vacuum cleaner which reduces the number of parts in assembling rear wheels of the mobile means and improving assembly thereof.

2. Description of the Prior Art

In general, an upright vacuum cleaner is a cleaning method with rotation of an agitator with a brush assembled by a rubber belt. As shown in FIG. 1, the upright vacuum cleaner comprises a suction inlet body(10) for cleaning a floor with rotation of the agitator including the brush assembled by the rubber belt at a motor shaft, a main body(20) rotatively installed with a filter for collecting dust and the like sucked through the suction inlet body(10) by suction force of driving means (not shown), a handle member(30) disposed at an upper portion of the main body(20) for pushing and dragging around the cleaner, and a suction hose(40) to be connected to the main body(20) for sucking dust with suction force of the driving means to be utilized by inserting into the suction inlet body(10) and to be stored by placing on the handle member(30).

As shown in FIG. 2, mobile means(50) is assembled at a lower portion of the main body(20). The mobile means(50) comprises a rotating shaft(51) rotatively installed at a body (21) of the main body(20), a washer(52) inserted throughout both lateral ends of the body(21), a pair of rear wheels(53) in a predetermined shape fitted at the washer(52) and rotatively inserted at the rotating shaft(51), and a stop ring(54) disposed at an end of the rotating shaft(51) not to get the rear wheels(53) diverted out of the rotating shaft.

Therefore, the washer(52) prevents an inner surface of the rear wheel(53) from being abraded with the body(21), and the stop ring(54) prevents the rear wheels(53) from being slipped out of the rotating shaft(51), thereby enabling the rear wheels(53) of the mobile means(50) to easily roll to move around when cleaning is carried out by holding the handle member(30).

However, there is a problem in the mobile means(50) of the conventional upright vacuum cleaner in that the number of parts thereof is large, thereby causing complicated assembling operations and increasing raw cost of the product.

SUMMARY OF THE INVENTION

The present invention is presented to solve the aforementioned problems and it is an object of the present invention to provide an upright vacuum cleaner which reduces the number of parts with installment of a rotating shaft rotatively inserted at a body and a pair of rear wheels coupled to a lateral surface of the body and improves assembly thereof.

In order to achieve the object of the present invention, there is provided an upright vacuum cleaner having a suction inlet body for cleaning a floor with rotation of the agitator including the brush assembled by the rubber belt at a motor shaft, a main body rotatively installed with a filter for collecting dust and the like sucked through the suction inlet body by suction force of driving means, a handle member disposed at an upper portion of the main body for pushing and dragging around, and a suction hose installed at the main body for sucking dust with suction force of the driving means to be utilized by inserting into the suction inlet body and to be stored by placing on the handle member, wherein the mobile means comprises:

a rotating shaft supported at an inner hole of a body composing of the main body being assembled in mobility and being protruded out of an outer hole with serration formed at both ends thereof; and a pair of rear wheels in a predetermined shape inserted along with serration of the rotating shaft and though the outer hole of the body being movable with limitation toward the rotating shaft.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
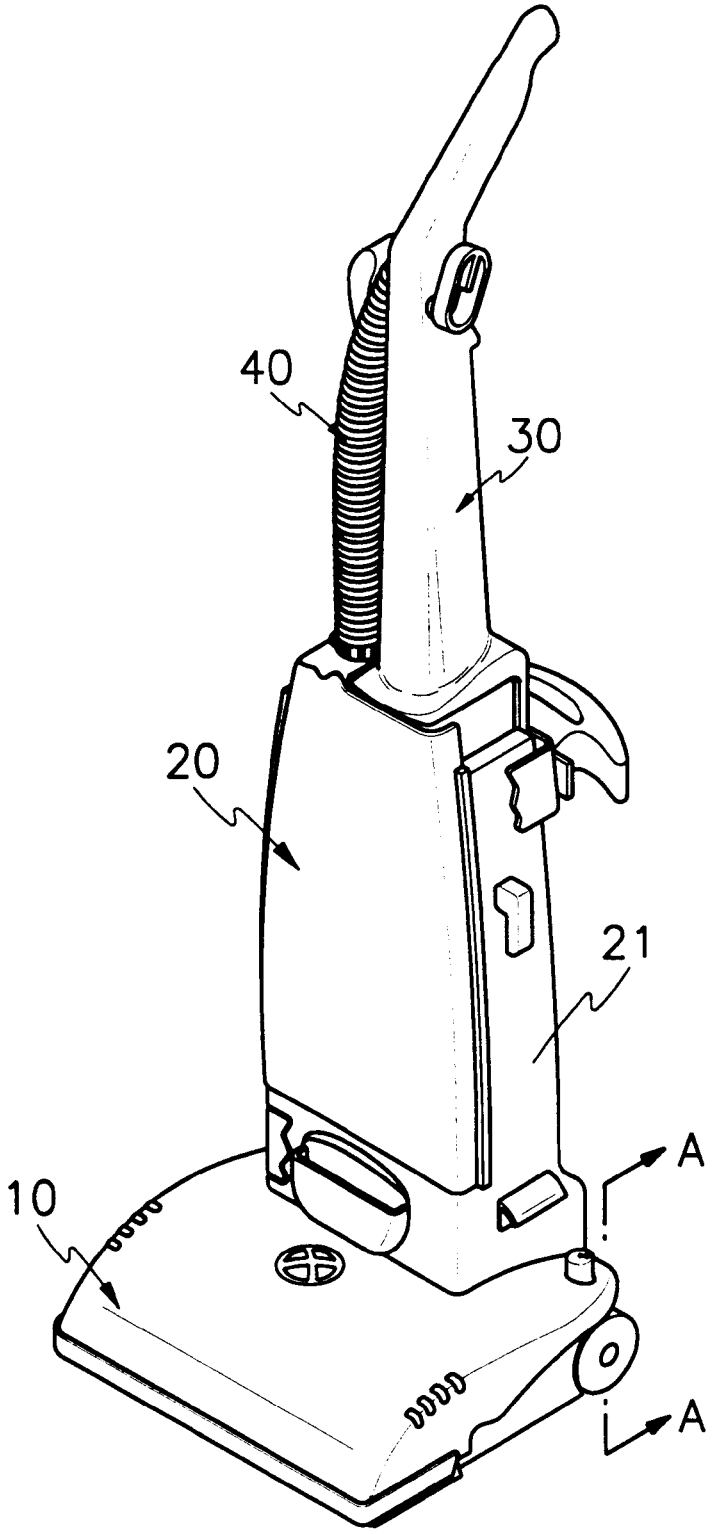
FIG. 1 is a perspective view of a conventional upright vacuum cleaner in accordance with the prior art.
Figure 2:
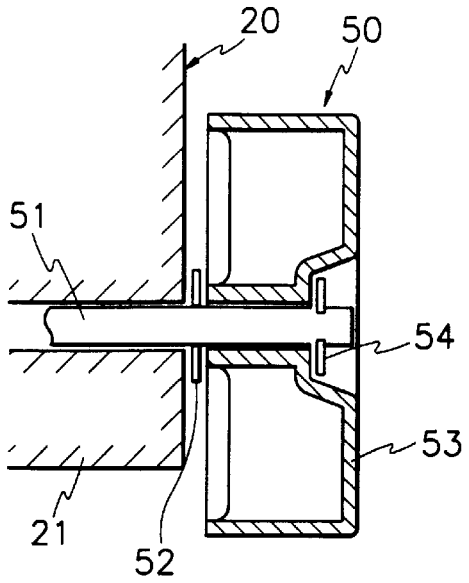
FIG. 2 is a sectional view taken along line 2—2 in FIG. 2.
Figure 3:
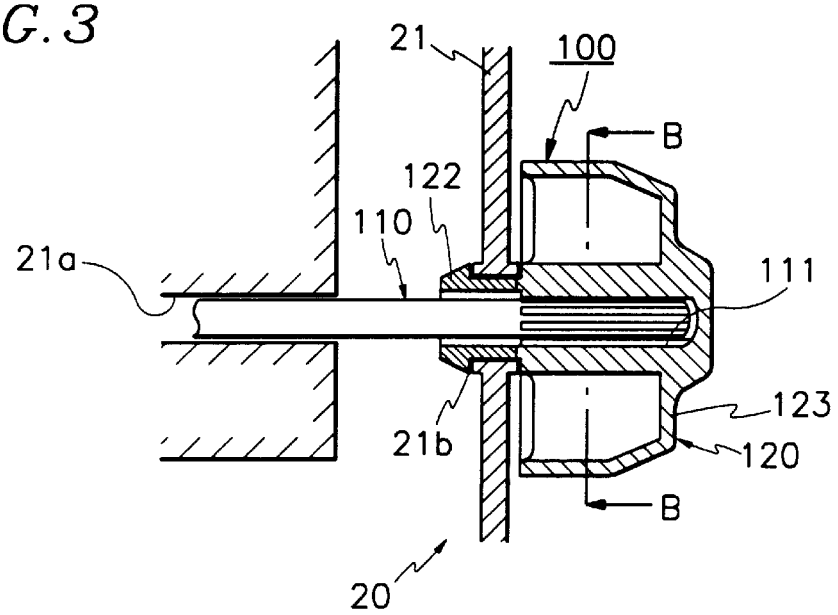
FIG. 3 is a view related to FIG. 2 for illustrating assembly of rear wheels in accordance with the present invention.
Figure 4:
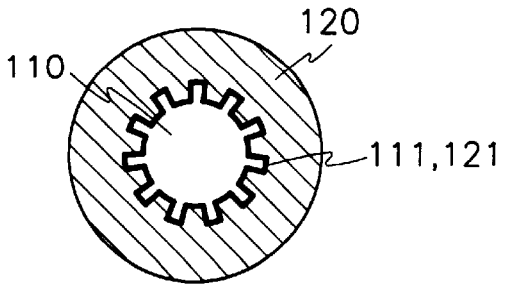
FIG. 4 is a sectional view taken along line 4—4 in FIG. 3.

An embodiment of the present invention is described in detail with reference to the accompanying drawings. FIG. 3 is a view related to FIG. 2 for illustrating assembly of rear wheels in accordance with the present invention, and FIG. 4 is a sectional view taken along line 4—4 in FIG. 3. Therefore, throughout the drawings, like reference numerals and symbols in FIGS. 1 and 2 are used for designation of like or equivalent parts or portions for simplicity of illustration and explanation, and redundant references will be omitted.

An upright vacuum cleaner of the present invention comprises a suction inlet body(10) for cleaning a floor with rotation of an agitator including a brush assembled by a rubber belt at a motor shaft, a main body(20) rotatively installed with a filter for collecting dust and the like sucked through the suction inlet body by suction force of driving means, a handle member(30) disposed at an upper portion of the main body for pushing and dragging around, and a suction hose(40) installed to be utilized by inserting into the suction inlet body(10) and to be stored by placing on the handle member(30), wherein the mobile means(100) comprises: a rotating shaft(110) supported at an inner hole(21*a*) of a body(21) composing of the main body being assembled in mobility and being protruded out of the outer hole(21*b*) with serration(111) formed at both ends thereof; and a pair of rear wheels(120) in a predetermined shape inserted along with the serration of the rotating shaft and though the outer hole of the body being movable with limitation toward the rotating shaft.

The rear wheel(120) includes serration grooves(121) formed around a central shaft for inserting serration of the rotating shaft(110), an elastic hook unit(122) disposed from an ending portion of the serration grooves(121) for getting rotatively fit to an outer hole(21*b*), and a wheel unit(123) having a predetermined diameter and forming serration around the outer surface thereof.

Next, operational effect of the present invention is described in detail. When cleaning is done by holding with the handle means(30), the rear wheels(120) and the rotating shaft(110) of the mobile means(100) are connected and rotated in serration, thereby freely getting moved around.

As weight of the cleaner is loaded at the inner hole(21*a*) which supports the rear wheels(120) and the rotating shaft (110), no weight is loaded on the hook unit(122) of the rear wheels(120), thereby preventing the rear wheels from being diverted toward the rotating shaft(110).

Apparent from the foregoing description, there are advantages of the present invention in that the number of parts to assemble rear wheels of the mobile means is reduced and assembly thereof is improved as the mobile means are composed of only rear wheels connected at the rotating shaft, movably inserted at the body and both lateral sides of the body.

Even if an embodiment of the present invention is described here, the actual scope of the present invention is not limited in the presented embodiment. It is believed evident that many variations be made by those skilled in the art without departing from the spirit and scope of this invention.

What is claimed is:

1. A vacuum cleaner comprising:

a mobile means having a rotating shaft supported at an inner hole of a body of the vacuum cleaner and protruded out of an outer hole the body with a serration formed at each end thereof, and a pair of rear wheels in a predetermined shape inserted along with the serrations of the rotating shaft and through the outer hole of the body being movable with a limitation toward the rotating shaft, wherein the rear wheels include:

serration grooves formed around a central shaft for fitting to the serration of said each end of the rotating shaft, an elastic hook unit disposed from an ending portion of the serration grooves for rotatively fitting to the outer hole, and a wheel unit having a predetermined diameter and forming a serration around an outer surface thereof, thereby reducing a number of parts in assembling the rear wheels of the mobile means and improving an assembly thereof.

* * * * *